US005518605A

United States Patent [19]

Hadj-Rabah et al.

[11] Patent Number: 5,518,605

[45] Date of Patent: May 21, 1996

[54] METHOD OF NITRIDING FERROUS METAL PARTS HAVING IMPROVED CORROSION RESISTANCE

[75] Inventors: Hocine Hadj-Rabah; Jean-Paul Terrat, both of Saint-Etienne, France

[73] Assignee: Centre Stephanois de Recherches Mecaniques Hydromecanique et Frottement, Andrezieux-Boutheon, France

[21] Appl. No.: 273,151

[22] Filed: Jul. 22, 1994

[30] Foreign Application Priority Data

Aug. 6, 1993 [FR] France ..... 93 09706

[51] Int. Cl.[6] ..... C25D 5/20; C25D 21/10; C25D 3/66; C25D 9/00

[52] U.S. Cl. ..... 205/148; 205/231; 205/320

[58] Field of Search ..... 205/148, 231, 205/320

[56] References Cited

U.S. PATENT DOCUMENTS

| | | | |
|---|---|---|---|
| 3,912,547 | 10/1975 | Gaucher et al. | 148/6.11 |
| 4,006,043 | 2/1977 | Gaucher et al. | 148/27 |
| 4,448,611 | 5/1984 | Grellet et al. | 148/6.11 |

FOREIGN PATENT DOCUMENTS

| | | |
|---|---|---|
| 0497663 | 8/1992 | European Pat. Off. . |
| 1408988 | 7/1965 | France . |
| 2171993 | 9/1973 | France . |
| 2271307 | 12/1975 | France . |
| 2525637 | 10/1983 | France . |
| 608257 | 12/1934 | Germany . |
| 1177899 | 9/1964 | Germany . |
| 1255438 | 11/1967 | Germany . |
| 2413643 | 3/1974 | Germany . |
| 2529412 | 1/1977 | Germany . |
| 1020534 | 2/1966 | United Kingdom . |

*Primary Examiner*—John Niebling
*Assistant Examiner*—Edna Wong
*Attorney, Agent, or Firm*—Young & Thompson

[57] ABSTRACT

In a nitriding method intended to confer upon ferrous metal parts, in addition to surface properties resulting directly from nitriding, corrosion resistance comparable to that obtained when the nitriding treatment is followed by an oxidizing treatment, in particular in a salt bath, the parts are treated by immersion for an appropriate time in a molten salt bath containing in the known manner essentially alkali metal carbonates and cyanates and a small quantity of a sulfur-containing substance. The parts are held at a positive potential relative to a counter-electrode in contact with the bath so that a high current flows through the bath from the parts to the counter-electrode and the concentration of cyanides formed by secondary reaction is kept below 6%. It is preferable to use a constant average current; the typical current densities are from 300 amperes to 800 amperes per $m^2$, the typical temperature ranges are from 450° C. to 650° C. and the typical treatment times are from 10 minutes to 150 minutes.

10 Claims, No Drawings

METHOD OF NITRIDING FERROUS METAL PARTS HAVING IMPROVED CORROSION RESISTANCE

BACKGROUND OF THE INVENTION

1. Field of the Invention

The invention concerns a method of nitriding ferrous metal parts, improving their corrosion resistance, in which the parts are treated by immersion for an appropriate time in a bath of molten salts essentially comprising alkali metal cyanates and carbonates.

2. Description of the Prior Art

Salt baths capable of diffusing metalloids, essentially nitrogen and possibly also carbon and sulfur, into the surface layers of ferrous metal parts to improve their resistance to wear and seizing have been known for many years. After using salt baths based on cyanides, the toxicity of which caused implementation problems, baths were used whose active element was essentially the cyanate ion $CNO^-$, the cations being alkali metals providing chemical stability in combination with a sufficiently low melting point.

Patents FR-A-2 171 993 and FR-A-2 271 307 describe baths of this kind in which the presence of lithium among the alkali metals and small quantities of sulfur-containing substances produce nitrided layers of better quality. FR-A-2 271 307 also describes a method of regenerating the baths by introduction of regenerating salts including, alongside nitrogen-supplying substances, at least one substance having a carboxyl group in its formula, whereby the cyanide concentration is maintained at the trace level, the sulfur acting as a catalyst for the regenerating agent.

As well as improving resistance to wear and seizing, nitriding improves corrosion resistance.

As is well known, the corrosion resistance of nitrided parts can be improved by immersing them for at least ten minutes in oxidizing salt baths including a mixture of alkali metal nitrates and hydroxides at temperatures between 360° C. and 500° C. Patent FR-A-2 525 637 describes a salt bath comprising alkali carbonates, hydroxides and nitrates with a small quantity of an oxygenating alkali metal salt whose oxyreduction potential relative to the reference hydrogen electrode is −1 volt or less. The use of this bath, which further requires the blowing in of air to keep the bath saturated with dissolved oxygen and to limit the concentration of solid particles, substantially increases corrosion resistance.

Nevertheless, the two-stage process: nitriding plus oxidation substantially increases the investment and the cost of manufacture, requiring a duplicated installation of crucibles and additional handling of the parts.

It has therefore been obvious that a single salt bath treatment to obtain the properties of parts subjected to nitriding and then oxidation would have great economical advantages.

SUMMARY OF THE INVENTION

To achieve this result, the invention proposes a method of nitriding ferrous metal parts to improve their corrosion resistance in which the parts are treated by immersion for an appropriate time in a bath of molten salts essentially comprising alkali metal carbonates and cyanates and containing a quantity of at least one sulfur-containing substance wherein during their immersion in the bath the parts are held at a positive electrical potential relative to a counter-electrode in contact with the bath such that a substantial current flows through the bath from the parts to the counter-electrode and the concentration of cyanides formed by secondary reaction is maintained below 6%.

We have discovered that passing current through the nitriding bath in the manner specified above leads to the formation of surface layers with new macrographic and micrographic appearances, which reflect the phenomena of oxyreduction which occurs at the interface between the salt bath and the parts, depending on the current.

Initial experiments showed that:

- if the parts are at a negative potential relative to the counter-electrode the cyanates are reduced at the interface to cyanides, and there is no diffusion of nitrogen into the parts;
- if the parts are at the same potential as the counter-electrode, the results are the same as for conventional nitriding;
- if the parts are at a positive potential relative to the counter-electrode, there occurs at the interface, firstly, oxidation of the parts and, secondly, reaction of the nitrogen with the iron of the substrate.

Very surprisingly, there are found in this third case layers of nitrides and oxides which are perfectly distinct and one on top of the other, with the nitrides in contact with the substrate and the oxides on the surface, rather than a mixture of the two substances.

The bath is preferably contained in a metal crucible forming the counter-electrode. Apart from the fact that this eliminates the need for a separate counter-electrode, the size and the shape of the crucible favor electrical field configurations within the molten salt bath which regularize the current density at the parts, so reducing the current density at the counter-electrode and commensurately reducing the significance of secondary oxyreduction phenomena occurring at the salt bath/crucible wall interface.

The mean current flowing through the bath is preferably maintained substantially constant throughout the treatment of the parts. It has been found that the properties of the layers formed on the parts by the treatment varied with the current density producing them. The results can therefore be reproducible only if the current is kept constant during the treatment.

The appropriate current density values are in the range from 300 $A/m^2$ to 800 $A/m^2$, the preferred range being from 450 $A/m^2$ to 550 $A/m^2$. If the (non-standardized) unit of current density conventionally employed in industrial electrochemistry, i.e. $A/dm^2$, are used, these ranges are from 3 $A/dm^2$ to 8 $A/dm^2$, preferably from 4.8 $A/dm^2$ to 5.5 $A/dm^2$.

The bath temperatures are conventionally in the range from 450° C. to 650° C. and preferably from 550° C. to 600° C.

The duration of treatment can be from 10 minutes to 150 minutes, the most effective treatment times being from 30 minutes to 100 minutes.

The preferred baths have a composition substantially equivalent to the compositions of FR-A-2 171 993, to be more precise with the following anionic and cationic concentrations:

| $CNO^-$ | $CO_3^{2-}$ | $K^+$ | $Na^+$ | $Li^+$ |
|---|---|---|---|---|
| 30–45% | 15–25% | 20–30% | 15–25% | 0.5–5% |

Their cyanide $CN^-$ concentration is below 2% and they contain at least one sulfur-containing substance in quantities such that the $S^{2-}$ concentration of the bath is between 1 ppm and 6 ppm.

In accordance with the teaching of FR-A-2 271 307, the bath is preferably kept at substantially the original composition by addition of regenerating agents and homogenization, which homogenization is preferably achieved by blowing in air.

DETAILED DESCRIPTION OF THE PREFERRED EMBODIMENTS

The features and advantages of the invention will be more clearly understood and appreciated from the following description and the examples included therein.

The method of the invention was developed by means of tests which sought to vary only one parameter at a time. Given that, in comparison with known nitriding processes, the teaching of the invention is to have an electrochemical process cooperate with a thermochemical nitriding process, with no a priori knowledge of the interaction that might occur between the two processes, a decision was taken to keep the thermochemical parameters (bath composition and temperature) fixed and to vary the electrochemical parameters (current density and quantity of electric charge passing through the path).

However, the quantity of charge parameter is, at constant current density, equivalent to the time for which the current is passed through the bath, which is also a thermochemical parameter.

A metal crucible was used containing 400 kg of molten salts as per FR-A-2 171 993 heated to 570° C. The chemical composition was kept constant in accordance with the teaching of FR-A-2 271 307 by periodic metered addition of regenerating salts and potassium sulfide. Air was blown into the crucible at a rate of 250 l/min to bring about homogenization.

Periodic filtering kept the concentration of solids in suspension at an acceptable level.

The test pieces were 1 mm thick XC38 steel plates 100 mm×100 mm (total surface area of both sides 2 $dm^2$). They were fixed to a metal bar mounted through and insulated from the upper opening of the crucible.

A direct current source rated at 10 amperes with the voltage and current stabilized had one pole connected to the crucible and the other to the current feed bar fixed to the test piece.

Before treatment in the salt bath the plate test pieces were degreased in trichloroethylene vapour. On removal from that bath after treatment the parts were cooled for two minutes in calm air at room temperature (to prevent thermal shock), rinsed in hot water (> 60° C.) for ten minutes, the water being agitated by blowing in air, and then dried with hot air.

The first tests were conducted with a constant applied voltage. It was found that the current through the salt bath decreased in time, probably representing the formation of polarizations at the interfaces of the bath with the electrodes (counter-electrode and, more importantly, the test pieces). It is thought that the potential drop in the bath itself remains substantially constant, given that the composition and the temperature of the bath are kept constant.

In parallel with the decrease in time in the current, with a constant supply voltage, divergences were found in the results of treating parts initially similar if the prior history of the crucible and the assembly for fixing the test pieces were different.

It was also found that the quality of the contact between the test piece and the current feed bar could have a very significant influence on the current through the bath and the reproducibility of the results.

With a regulated and stabilized current the reproducibility of the results was very good, provided that the contact between the test pieces and the current feed bar was not subject to any resistance fluctuation.

I. First Series of Tests—Determination of the Operative Current Density

It will be remembered that with parts at a negative potential relative to the counter-electrode no nitrided layer appeared on the surface of the part; in this case the part is an electron donor and the cyanates of the bath are reduced to cyanides at the interface, with no release of nitrogen.

If no voltage is applied between the test piece and the counter-electrode the result is the same as for conventional nitriding, which constitutes a comparison reference for the treatment of the invention.

The current flowing through the bath was therefore increased in steps between the series of tests. Hereinafter the current is expressed as a current density, which is a parameter that is substantially invariant for the transposition of the test piece dimensions. In this series of tests the active surface area of the test pieces was 2 $dm^2$. The current was therefore set to 2, 4, 6, 8 and 10 amperes, i.e. to 1, 2, 3, 4 and 5 $A/dm^2$.

The treatment time in this series of tests was uniformly 90 minutes.

In all cases there was observed the formation in contact with the substrate of a dense white layer comparable to that of the reference test piece nitrided with no current flowing.

The morphology of another layer on top of the first depended on the current density:

up to 3 $A/dm^2$ this was a porous layer, of the same kind as observed on the reference sample, but much thicker (20 μm to 25 μm, instead of a few μm), from 4 $A/dm^2$ it was a dense grey layer approximately 20 μm thick.

The test pieces underwent corrosion tests. Two methods were used: measurement of the corrosion potential in a de-aerated 3% NaCl solution, and determination of the duration of exposure to standardized salt spray before appearance of traces of corrosion. For these tests the edges of the plates were protected with varnish to prevent surface state anomalies in the immediate vicinity of sharp edges interfering with the tests. The results are set out in table 1 below:

TABLE 1

| Current density ($A/dm^2$) | Corrosion potential (mV) | Exposure to salt spray (hours) |
|---|---|---|
| 1 | −490 | <24 |
| 2 | −420 | <24 |
| 3 | −380 | <24 |
| 4 | +1 500 | >312* |
| 5 | +1 400 | 504 |

*This test was stopped after 312 hours because of a defect in the protection of the edge, causing a run of corrosion.

The considerable increase in corrosion resistance shown by these tests is operative at the same time as the dense grey layer is formed. The correlation between the appearance of a dense grey layer and the good corrosion resistance was confirmed by another test and has not been disproved since.

II. Second Series of Tests—Effect of Time

A series of tests was carried out under the same conditions as previously, except that the current densities used were 4 $A/dm^2$ and 5 $A/dm^2$ while the durations were 30 minutes, 60 minutes, 90 minutes and 120 minutes.

At 4 $A/dm^2$ for 30 minutes layers were formed similar to those obtained in the previous series with currents up to 3 $A/dm^2$, i.e. a dense white layer on the substrate and a porous layer on top of this. At 60 minutes the thicknesses of the two layers increased and at the same time the upper part of the porous layer darkened. The dense grey layer appeared at 90 minutes. Its thickness was increased at 120 minutes.

At 5 $A/dm^2$ the dense grey layer had already begun to form after 30 minutes. At 60 minutes it was comparable with that obtained after 90 minutes at 4 $A/dm^2$. It then continued to grow, but started to become porous at 120 minutes while the deep white layer showed signs of deterioration.

The condition of the layers formed on the surface of the test pieces is not different below and above a current threshold, but evolves in time substantially identically whatever the current density, at rates which are a direct function of the current density, but nonlinear (the rate increases much faster than the current density).

The corrosion resistance tests corroborated those of the first series, i.e. the test pieces on which the layers formed included a dense grey layer had a corrosion resistance very much higher than that of layers nitrided with no current and in the same range of corrosion resistance values as obtained by oxidizing salt bath treatment after conventional nitriding treatment with no current. The oxidizing salt bath was a bath as per FR-A-2 525 637, for example.

III. Third Series of Tests—Phage Analysis

Three plates were treated at 4 $A/dm^2$, for 15 minutes, 60 minutes and 90 minutes, respectively; they were then examined by X-ray diffraction (phase analysis) and by LDS (luminescent discharge spectroscopy) (elemental analysis). The results are summarized in table 2 below:

TABLE 2

| Treatment time (min) | Current density ($A/dm^2$) | Phase analysis | LDS analysis |
|---|---|---|---|
| 15 | 4 | $Fe_{2-4}N + Fe_3O_4 + Li_2Fe_3O_4$ | traces of Li |
| 60 | 4 | $Fe_{2-4}N + Fe_3O_4 + LiFe_5O_8$ | traces of Li |
| 90 | 4 | $Fe_{2-4}N + Fe_3O_4$ | — |

These analyses confirm the presence of iron nitrides, the constituent of the dense white layer and the framework of the porous part. They also show the presence of iron oxide and iron/lithium oxides, which constituted the dense grey layer.

Qualitatively, increasing the treatment time, which favors the formation of the corrosion protection layer, is accompanied by enrichment with iron oxide $Fe_3O_4$ and disappearance of lithium oxide.

The correlation between the densification of the protection layer and elimination of the lithium is not an indicator of a specific action of the lithium in an intermediate stage and the presence of the lithium, the great mobility of which in $Fe_3O_4$, even at low temperatures, is well known, can only be indicative of a modification to the structure of the protection layer.

What is more, the tests overall confirmed that, when the protection layer is formed, its anticorrosion properties depend in the main on its compactness and thickness; no influence of its composition has been found.

IV. Role of the Constituents of the Bath

Because of the number of parameters to be varied to control the process of the invention, the above tests were carried out with the same bath composition and could give no information as to the role of the various constituents of the bath, either present from the outside or resulting from deterioration of the original composition. The role of the individual constituents were therefore investigated by means of further tests. The general electrochemical and thermochemical knowledge of the person skilled in the art provided some guidance in this respect, but were evidently insufficient in themselves to render the tests unnecessary or to indicate operating conditions.

a) The person skilled in the art knows that the active component in molten salt nitriding baths similar to those of the present invention is the cyanate anion $CNO^-$ which, by dismutation due to temperature and oxidation, releases strongly reactive nascent nitrogen, capable of diffusing into the ferrous substrate.

By applying to the test pieces an electrical potential relative to the bath (in fact relative to the counter-electrode) the equilibrium states of the above reactions are moved.

When this potential is negative, there is produced at the test piece/bath interface a reduction of cyanates to cyanide, accompanied by reduced diffusion of nitrogen into the substrate;

On the other hand, if this potential is positive, oxidation is favoured, with the formation of nascent nitrogen, and consequent acceleration of nitriding.

Note that, when the potential is positive, the flow of current simultaneously oxidizes the iron of the substrate, in competition with oxidation of the cyanates.

b) The formation and diffusion into the bath of reducing cyanide anions $CN^-$ resulting from the reduction of the cyanate, in particular at the bath/counter-electrode interface, is prejudicial to the formation of the oxide layer on the test piece. When, in accordance with the invention, the test piece is held at a positive potential relative to the bath, there occurs at the test piece/bath interface competition between oxidation of the cyanates and oxidation of the diffused cyanides, depending on the cyanide concentration, of course. Systematic tests have shown two thresholds for the cyanide concentration which are both critical, namely 2% and 6%.

Below 2% $CN^-$ anions the oxide protection layer (dense grey layer) forms normally;

Above 6% $CN^-$ anions formation of the oxide layer is inhibited;

From 2% to 6% $CN^-$ anions the dense oxide layer becomes progressively more and more porous and thinner and thinner. It is concluded that, in all circumstances, the bath must be regenerated in order to prevent the cyanide concentration reaching 6%, and advantageously to maintain the cyanide concentration below 2%.

c) An important role for the concentration of sulfur-containing substances with the bath was also shown. In the absence of sulfur the oxide layer forms but its density is low and it is subject to cracks, so that the impermeability of the surface is highly imperfect, as confirmed by poor corrosion resistance of the test pieces: the corrosion potential is negative, below −250 mV.

Above 1 ppm of $S^{2-}$ in the bath, the quality of the layer is significantly improved, with the optimum obtained between 2 ppm and 5 ppm.

Above 6 ppm the nitrided layer deteriorates and becomes porous throughout its thickness, which reduces the corrosion resistance and the wear resistance of the parts treated.

V. Tribological Properties of the Treated Parts

The goods resistance to wear and seizing of sulfonitrided ferrous metal parts (FR-A-2 171 993) or parts nitrided and then oxidized (FR-A-2 525 637) are well known.

Given the composition and the metallurgical characteristics of the parts treated in accordance with this application, there was no significant a priori reason for their tribological properties to differ significantly from those obtained with known methods.

It was nevertheless necessary to verify this, which was done by friction tests carried out under the following conditions:

reciprocating linear motion type of contact: plane/plane (cursor/track type)

speed: 0.1 m/s travel: 84 mm pressure: 20 bars (2 MPa)

temperature: room temperature surroundings: either dry (in air) or in oil surfaces: chromium-plated steel track, nitrided/oxidized steel cursor.

The nitriding/oxidation treatment was carried out under the conditions of example 1 with a current density of 5 A/dm$^2$ for periods of 30 minutes (marker A) and 60 minutes (marker B). Cursors treated for 90 minutes with no current (marker C) as per FR-A-2 171 993 were used as a control.

The results are summarized in table 3 below:

TABLE 3

| Reference | Surroundings | Cycles | Coefficient of friction start | Coefficient of friction end |
|---|---|---|---|---|
| A | dry | 12 000 | 0.1 | 0.26 |
| | oil | 25 000 | 0.08 | 0.07 |
| B | dry | 1 000 | 0.09 | 0.33 |
| | oil | 25 000 | 0.07 | 0.07 |
| C | dry | 1 000 | 0.3 | 0.45 |
| | oil | 25 000 | 0.07 | 0.05 |

From the friction aspect, the parts treated with current (A, B) and without current (C) behave similarly when lubricated.

Dry, the A parts (5 A/dm$^2$, 30 minutes) behaved slightly better than the B parts (5 A/dm$^2$, 60 minutes); given the dispersion that is typical of dry friction tests, the difference is not statistically significant, however. In any event, the control parts C had much less favorable performance.

VI. Treatment of Charges of Parts

It was decided to verify if the effects observed were due to the fact that, in all the preceding examples, isolated parts were treated, or at least a small number of parts, or would be found for treating complete charges.

An experimental bath was therefore set up as used in I and II with a salt capacity of 800 kg and treatment carried out therein at a current density of 5 A/dm$^2$, the crucible providing the counter-electrode, the charges comprising 10 mm diameter spindles, 100 mm long screw-threaded at one end. Each charge included 300 parts with a total weight of 30 kg. The spindles were attached to mountings to leave a gap between two consecutive spindles of 10 mm to 50 mm, depending on the charge.

In all cases the processing was carried out under good conditions. The results of corrosion tests carried out on spindles selected from various points in the charge were compatible with those obtained for the first series of tests previously described in section I above.

It thus seems that the main advantage of the invention resides in the considerable increase in corrosion resistance, which in many cases rules out the need to carry out anti-corrosion treatment after nitriding.

It goes without saying that the invention is not limited to the examples described and encompasses all variant executions within the scope of the claims.

Thus the use of nitriding salt baths containing no lithium, which have equivalent nitrogen release kinetics, is within the scope of the invention.

Moreover, given the conclusions under item 2 above, it does not seem necessary for the current flowing through the bath to be a strictly direct current, and this current could be an unfiltered unidirectional current or a pulsed current.

Finally, the surface condition of the parts and the composition of the surface layers would be favorable to applying a varnish or a wax, of benefit in some applications.

There is claimed:

1. Method of nitriding ferrous metal parts to improve their corrosion resistance which comprises: immersing the parts for a treatment time ranging from 10 to 150 minutes in a bath of molten salts comprising essentially alkali metal carbonates and cyanates and containing a quantity of at least one sulfur-containing substance, and holding the parts during immersion in the bath at a positive electrical potential relative to a counter-electrode in contact with the bath such that a substantial current flows through the bath from the parts to the counter-electrode and concentration of cyanide anions formed by secondary reaction is maintained below 6%, to form distinct layers of nitrides and oxides, with the nitrides being in contact with the parts, and the oxides being formed thereon, wherein the current flowing through the bath corresponds to a current density at the parts between 300 and 800 amperes per square meter, and the bath having a temperature between 450° and 650° C.

2. Method according to claim 1 wherein the bath is contained in a metal crucible forming the counter-electrode.

3. Method according to claim 1 wherein the current flowing through the bath is kept substantially constant during the immersion of the parts in the bath.

4. Method according to claim 3 wherein the current density at the parts is between 450 A/m$^2$ and 550 A/m$^2$.

5. Method according to claim 1 wherein the bath includes the following composition 30% to 45% of $CNO^-$ anions, 15% to 25% of $CO_3^{2-}$ anions, 20% to 30% of $K^+$ cations, 15% to 25% of $Na^+$ cations and 0.5% to 5% of $Li^+$ cations, the $CN^-$ anion concentration of the bath is less than 2% and said bath also includes at least one sulfur anion-containing substance in a quantity such that the $S^{2-}$ anion concentration is between 1 ppm and 6 ppm.

6. Method according to claim 5 wherein the composition of the bath is maintained substantially constant by addition of regenerating and stabilizing agents.

7. Method according to claim 6 wherein the cyanide anion concentration of the bath is kept at 2% or below.

8. Method according to claim 1 wherein the bath is homogenized by blowing in air.

9. Method according to claim 1, wherein the temperature of the salt bath is between 550° C. and 600° C.

10. Method according to claim 1, wherein the treatment time is from 30 minutes to 100 minutes.

* * * * *